US007255532B2

(12) United States Patent
Zheng

(10) Patent No.: US 7,255,532 B2
(45) Date of Patent: Aug. 14, 2007

(54) BI-DIRECTIONAL BLOWERS FOR COOLING COMPUTERS

(76) Inventor: Wen-Chun Zheng, 551 Crystalberry Ter., San Jose, CA (US) 95129

( * ) Notice: Subject to any disclaimer, the term of this patent is extended or adjusted under 35 U.S.C. 154(b) by 208 days.

(21) Appl. No.: 11/080,764

(22) Filed: Mar. 14, 2005

(65) Prior Publication Data

US 2006/0078428 A1 Apr. 13, 2006

Related U.S. Application Data

(63) Continuation-in-part of application No. 10/711,852, filed on Oct. 8, 2004, now abandoned.

(51) Int. Cl.
*F04D 29/44* (2006.01)

(52) U.S. Cl. ..... 415/183; 415/186; 415/203; 415/224

(58) Field of Classification Search ..... 415/183, 415/184, 185, 186, 203, 204, 206, 224
See application file for complete search history.

(56) References Cited

U.S. PATENT DOCUMENTS 5,816,319 A 10/1998 Kamekawa et al.
6,111,748 A 8/2000 Bhatia
6,407,921 B1 6/2002 Nakamura et al.
6,643,129 B2 11/2003 Fujiwara
6,652,223 B1 11/2003 Horng et al.
6,653,755 B2 11/2003 Machiroutu
6,744,631 B1 6/2004 Chuang et al.
6,752,201 B2 6/2004 Cipolla et al.

*Primary Examiner*—Edward K. Look
*Assistant Examiner*—Dwayne J White
(74) *Attorney, Agent, or Firm*—Patent Law Group LLP; David C. Hsia

(57) ABSTRACT

A heat dissipating device includes a motor, a rotary unit, and a housing for receiving the motor and the rotary unit. The rotary unit includes a hub mounted to the motor and blades extending from the hub. The housing defines a hot air inlet, a hot air outlet, a cold air inlet, and a cold air outlet. The housing includes a first partition and a second partition located close to outer ends of the blades. The two partitions divide the housing into a first channel coupling the hot air inlet and the hot air outlet, and a second channel coupling the cold air inlet and the cold air outlet. The two partitions have widths greater than a pitch of the blades to prevent air from mixing in the two channels. The two channels create a bi-directional blower that removes hot air from and provides cold air into a computer case.

21 Claims, 10 Drawing Sheets

BI-DIRECTIONAL BLOWERS FOR COOLING COMPUTERS

CROSS-REFERENCE TO RELATED APPLICATIONS

This application is a continuation-in-part of U.S. application Ser. No. 10/711,852, entitled "Bi-Directional Blowers for Cooling Laptop Computers," filed Oct. 8, 2004, now abandoned which is incorporated herein by reference.

FIELD OF INVENTION

This invention relates to the field of thermal management for computer and electronic systems, and more specifically to bi-directional blowers for cooling laptop computers.

DESCRIPTION OF RELATED ART

Fans and blowers are essential components in active air cooling of computer and electronic systems as the power of these systems increase. To improve air cooling, duct cooling is also utilized. As the heat density in a system is different in various zones, the ideal approach is to immediately remove heat from the hot region inside the system box through ducts to the outside. However, this is a real challenge due to the compact design of the system box that fits many different components, such as CPU, PCI components, graphics processors, network processors, and memory.

Axial fans are normally used in desktop and server systems. They efficiently move air in one direction because their blades cut air stream from the inlet and move it to the outlet immediately. Blowers are commonly used in laptops because they can change the air flow direction, fit in small spaces, and cool small hot devices such as heat sinks. A centrifugal blower is not as efficient as an axial fan of the same size because (1) the blower's inlet is smaller; (2) the air is driven less efficiently using centrifugal force generated by the fast rotation of the blades or impellers; (3) most of the air goes through a circular tunnel in the blower before it escapes through the outlet; and (4) the air experiences drag against the walls of the circular tunnel during its passage through the blower.

Overheating is a common problem for high power laptops. As discussed above, blowers are commonly used for laptop cooling due to space limitations. The inlet of a centrifugal blower is usually located at the bottom of the laptop near the CPU. This requires an air gap greater than 2 millimeters between the bottom of the laptop and the desktop so that ambient air can be drawn into the blower. Unfortunately, the air gap provides a large thermal resistance in the heat transfer path between the bottom of the laptop and the desktop. Assuming the desk is made of wood, its thermal conductivity is about 7 to 12 times of air. Clearly, the thinner the air gap, the more efficient the heat dissipation through the bottom of the laptop becomes because the desk underneath can be utilized as a large natural heat sink.

BRIEF DESCRIPTION OF THE DRAWINGS

Use of the same reference numbers in different figures indicates similar or identical elements.

SUMMARY

In one embodiment of the invention, a heat dissipating device includes a motor, a rotary unit, and a housing for receiving the motor and the rotary unit. The rotary unit includes a hub mounted to the motor and blades extending from the hub. The housing defines a hot air inlet, a hot air outlet, a cold air inlet, and a cold air outlet. The housing includes a first partition and a second partition located close to outer ends of the blades. The first and the second partitions divide the housing into (1) a first channel coupling the hot air inlet and the hot air outlet and (2) a second channel coupling the cold air inlet and the cold air outlet. The first and the second partitions have widths greater than a pitch of the blades to prevent air from mixing in the first and the second channels. The two channels create a bi-directional blower that removes hot air from and provides cold air into a computer case.

DETAILED DESCRIPTION

One objective of the present invention is to provide a bi-directional blower that simultaneously blows hot air out from a system box and draws ambient air into the system box.

Another objective of the present invention is to provide airfoils in the inlet and the outlet of a blower to control air flow volume and velocity for more efficient air cooling.

Another objective of the present invention is to provide a bi-directional blower that can be used for space constrained conditions, such as in laptop computers, thin blade servers, and PCI cards (e.g., graphics cards), for efficient duct cooling.

Another objective of the present invention is to provide a bi-directional blower that draws air into the blower by "negative pressure" to enhance heat dissipation for a laptop computer where the inlets and outlets are located on the side of the laptop. Thus, the air gap between the bottom of the laptop and the desktop can be eliminated and the desk can serve as a natural heat sink.

Another objective of the present invention is to provide a hybrid bi-directional blower that draws air into the blower by "negative pressure" and blows air out of the blower by centrifugal force.

Another objective of the present invention is to provide a bi-directional blower utilizing a rotary unit having a combination of blades and impellers to improve air flow.

Figure 1:
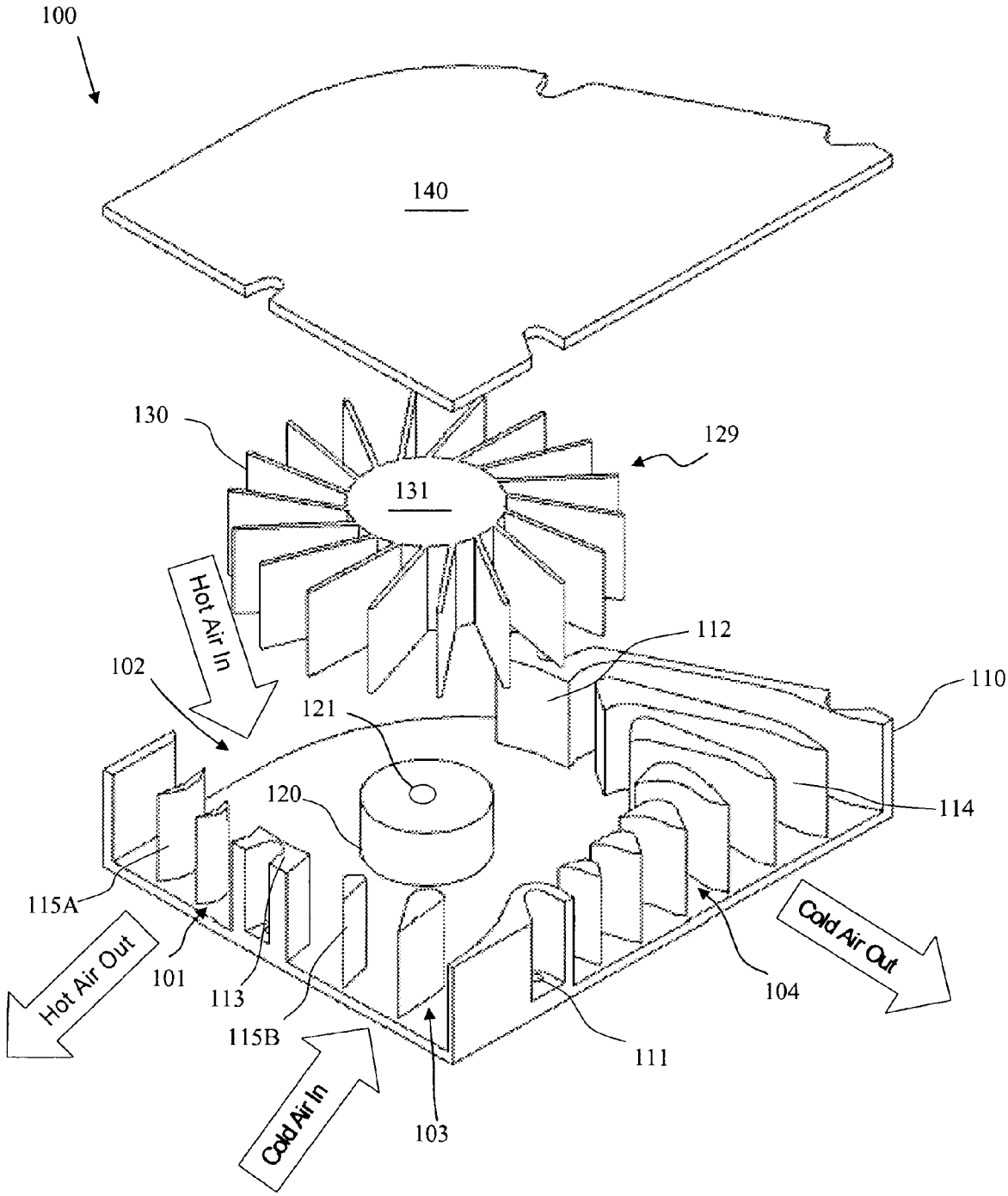
FIG. 1 is an exploded view of a bi-directional blower in one embodiment of the invention.

FIG. 1 illustrates a bi-directional blower 100 in one embodiment of the invention. Blower 100 includes a housing 110, a motor 120, and a rotary unit 129. In one embodiment, rotary unit 129 includes blades 130 (only one is labeled for clarity) extending from a hub 131. Hub 131 is mounted to a rotor 121 of motor 120. Motor 120 has a stator (not visible) that is mounted to housing 110. A cover 140 encloses the components within housing 110. Housing 110 define screw holes 111 (only one is labeled for clarity) for mounting blower 100 to a system box.

In one embodiment, housing 110 has openings in the sidewalls that define a hot air inlet 102, a hot air outlet 101, a cold air inlet 103, and a cold air outlet 104 arranged in that order. Furthermore, the sidewall between hot air inlet 102 and cold air outlet 104 protrudes toward the outer ends of blades 130 to form a partition 112, and the sidewall between hot air outlet 101 and cold air inlet 103 protrudes toward the outer ends of blades 130 to form a partition 113.

Partitions 112 and 113 divide housing 110 into a hot channel for moving air from hot air inlet 102 to hot air outlet 101, and a cold channel for moving air from cold air inlet 103 to cold air outlet 104. Partitions 112 and 113 have widths greater than the pitch of blades 130 to prevent the air in the hot and the cold channels from mixing. When blades 130 rotate counterclockwise, hot air is pushed out through hot air outlet 101 and drawn in through hot air inlet 102, and cold air is pushed out through cold air outlet 104 and drawn in through cold air inlet 103. This is because when air is pushed out through outlets 101 and 104 by centrifugal force, the air density is lowered in the space between adjacent blades 130. As blades 130 rotate past partitions 112 and 113, the "negative pressure" difference between the ambient air pressure and the space between adjacent blades 130 draws air from outside of blower 100 into the space between adjacent blades 130. Thus, the rotation of blades 130 acts to blow out and suck in air in two separate channels.

Note that hot air outlet 101 is located adjacent to cold air inlet 103. To prevent the exiting hot air from mixing with the entering cold air, hot air outlet 101 is made smaller than cold air inlet 103. This causes the exiting hot air to travel at a greater velocity than the entering cold air, thereby preventing the mixing of hot and cold airs.

Housing 110 further includes stationary airfoils 114 (only one is labeled for clarity) at cold air outlet 104, stationary airfoils 115A (only one is labeled for clarity) at hot air outlet 101, and stationary airfoils 115B (only one is labeled for clarity) at cold air inlet 103. The placement and the shape of the stationary airfoils provide the desired air flow distribution and air flow direction. For example, stationary airfoils 114 ensure that the cold air exiting through cold air outlet 104 is distributed evenly across cold air outlet 104. This improves the cooling of any heat sink placed next to the outlet. Furthermore, stationary airfoils 114 ensure that the cold air exits perpendicular to cold air outlet 104. This prevents the cold air from vibrating the fins of the heat sink and generating noise. In addition, stationary airfoils 115A help to direct the hot air out through hot air outlet 101 and stationary airfoils 115B help to direct the cold air from cold air inlet 103 to cold air outlet 104. The exact placement and shape of the stationary airfoils can be calculated through computational fluid dynamics.

Figure 2:
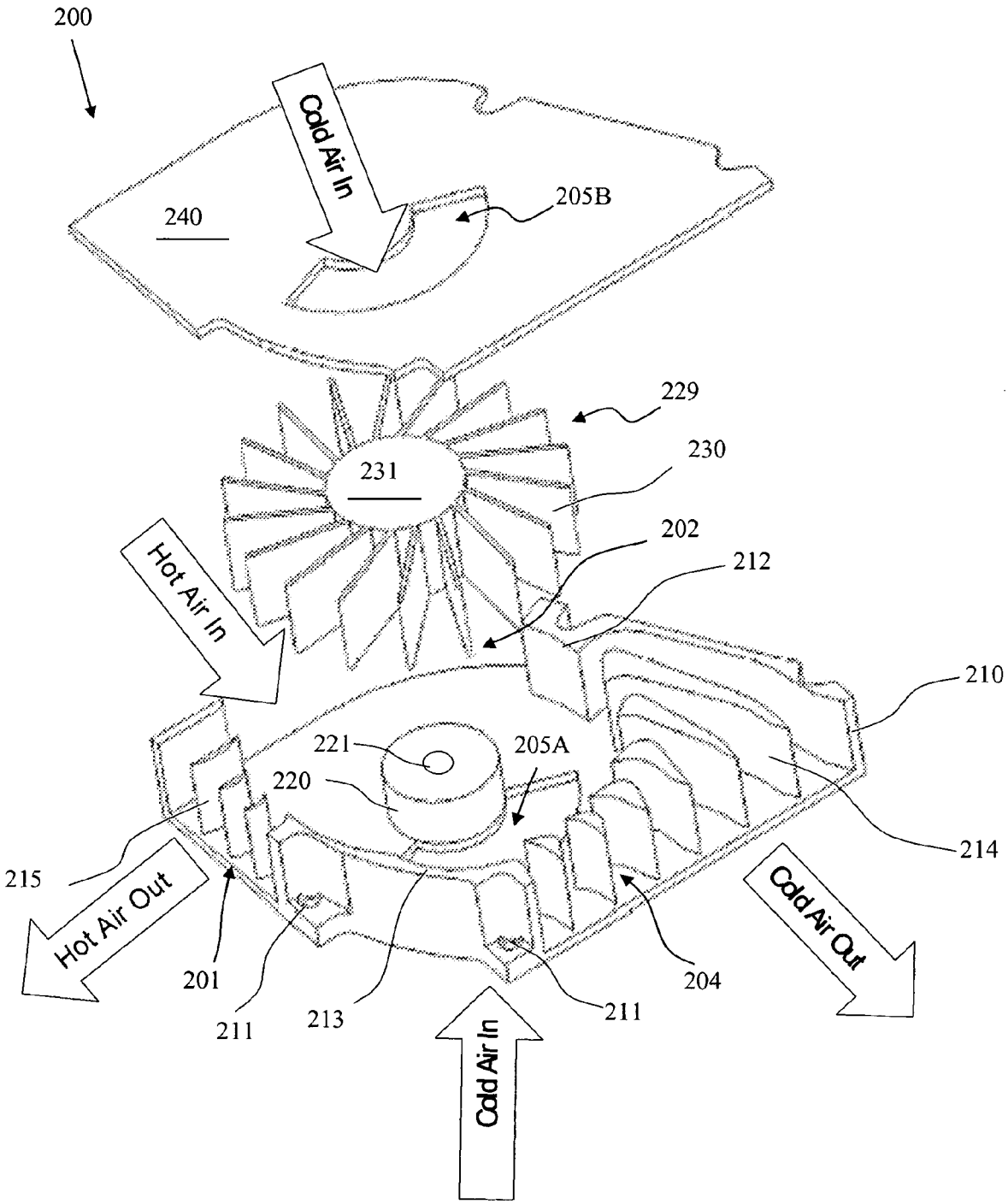
FIG. 2 is an exploded view of a hybrid bi-directional blower in one embodiment of the invention.

FIG. 2 illustrates a hybrid bi-directional blower 200 similar to bi-directional blower 100 in one embodiment of the invention. Blower 200 includes a housing 210, a motor 220, and a rotary unit 229. In one embodiment, rotary unit 229 includes blades 230 (only one is labeled for clarity) extending from a hub 231. Hub 231 is mounted to a rotor 221 of motor 220. Motor 220 has a stator (not visible) that is mounted to housing 210. A cover 240 encloses the components within housing 210. Housing 210 define screw holes 211 (only two are labeled for clarity) for mounting blower 200 to a system box.

In one embodiment, housing 210 has openings in the sidewalls that define a hot air inlet 202, a hot air outlet 201, and a cold air outlet 204 arranged in that order. Depending on the embodiment, housing 210 may have an opening in the bottom surface that defines a cold air inlet 205A, or cover 240 may have an opening that defines cold air inlet 205B. The sidewall between hot air inlet 202 and cold air outlet 204 protrudes toward the outer ends of blades 230 to form a partition 212, and the sidewall between hot air outlet 201 and cold air outlet 204 protrudes toward the outer ends of blades 230 to form a partition 213.

Partitions 212 and 213 divide housing 210 into a hot channel for moving air from hot air inlet 202 to hot air outlet 201, and a cold channel for moving air from cold air inlet 205A/B to cold air outlet 204. Partitions 212 and 213 have widths greater than the pitch of blades 230 to prevent the air from the hot and the cold channels from mixing. When blades 230 rotate counterclockwise, hot air is pushed out through hot air outlet 201 by centrifugal force, and hot air is drawn in through hot air inlet 202 by "negative pressure." Similarly, cold air is pushed out through cold air outlet 204 by centrifugal force, and cold air is drawn in through cold air inlet 205A/B by "negative pressure."

Housing 210 further includes stationary airfoils 214 (only one is labeled for clarity) at cold air outlet 204, and stationary airfoils 215 (only one is labeled for clarity) at hot air outlet 201. Stationary airfoils 214 and 215 control air flow distribution and air flow direction For example, stationary airfoils 214 ensure that the cold air exiting through cold air outlet 204 is distributed evenly across the outlet. Furthermore, stationary airfoils 214 ensure that the cold air exits perpendicular to outlet 204. In addition, stationary airfoils 215 help to direct hot air out through hot air outlet 201. The exact placement and shape of the stationary airfoils can be calculated through computational fluid dynamics.

Blower 200 is called a hybrid because cold air inlet 205A/B is located at the top or the bottom of blower 200 like a conventional centrifugal blower. Blower 200 transports air very efficiently because it eliminates air travel in the circular tunnel of a conventional centrifugal blower. Although the volume of the cold air flow is not as high as a conventional centrifugal blower of the same size, the total efficiency is improved because the hot channel draws in hot air from the system box and blows it out of the system box.

Figure 3A:
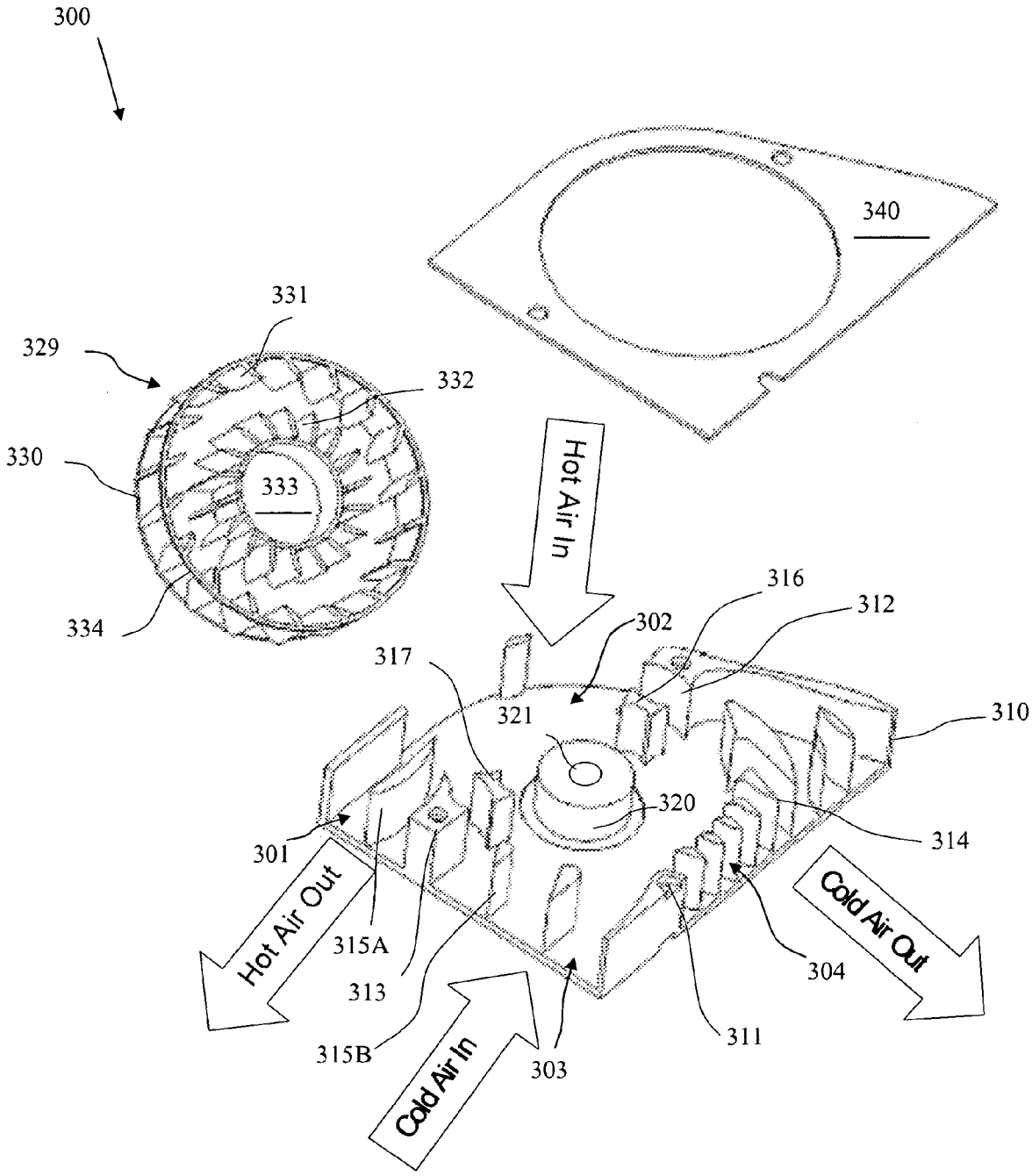
FIGS. 3A and 3B are exploded and top views of a bi-directional blower in one embodiment of the invention.
Figure 3B:
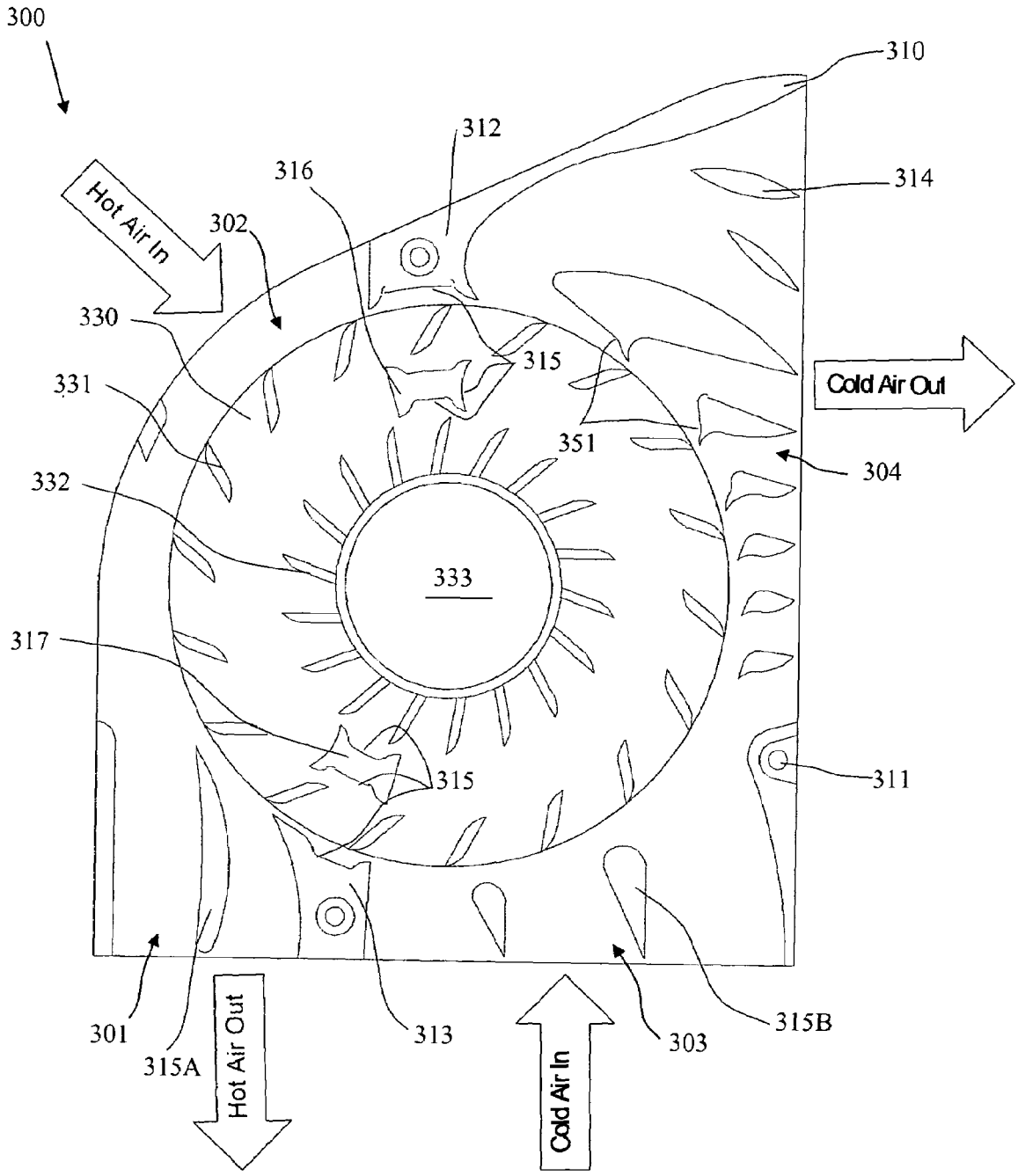

FIGS. 3A and 3B illustrate a bi-directional blower 300 in one embodiment of the invention. Blower 300 includes a housing 310, a motor 320, and a rotary unit 329. In one embodiment, rotary unit 329 includes a circular plate 330, outer impellers 331 around the outer perimeter of plate 330, a hoop 334 on top of the outer impellers 331, and inner blades 332 around a hub 333 on plate 330. Hoop 334 increases the structural rigidity of outer impellers 331 in order to minimize noise due to the vibration of outer impellers 331. Hub 333 is mounted to a rotor 321 of motor 320. Motor 320 has a stator (not visible) that is mounted to housing 310. A cover 340 encloses the components within housing 310. Housing 310 define screw holes 311 (only one is labeled for clarity) for mounting blower 300 to a system box.

In one embodiment, housing 310 has openings in the sidewalls that define a hot air inlet 302, a hot air outlet 301, a cold air inlet 303, and a cold air outlet 304 arranged in that order. Hot air outlet 301 is made smaller than cold air inlet 303 to prevent mixing of the hot and cold airs. The sidewall between hot air inlet 302 and cold air outlet 304 protrudes toward the outer ends of outer impellers 331 to form an outer partition 312, and the sidewall between hot air outlet 301 and cold air inlet 303 protrudes toward the outer ends of outer impellers 331 to form an outer partition 313. Opposite of partition 312 is an inner partition 316 that fits between the outer ends of inner blades 332 and inner ends of outer impellers 331. Opposite of outer partition 313 is an inner partition 317 that fits between the outer ends of inner blades 332 and the inner ends of outer impellers 331. Inner blades 332 are designed to rotate between inner partitions 316 and 317. Outer impellers 331 are designed to rotate between inner partition 317 and outer partition 313, and between inner partition 316 and outer partition 312.

Partitions 312, 316, 313, and 317 divide housing 310 into a hot channel for moving air from hot air inlet 302 to hot air outlet 301, and a cold channel for moving air from cold air inlet 303 to cold air outlet 304. Partitions 312, 316, 317, and 315 have widths greater than the pitches of blades 331 and 332 to prevent the air from the hot and cold channels from mixing. When rotary unit 329 rotates counterclockwise, hot air is pushed out through hot air outlet 301 by centrifugal force, and hot air is drawn in through hot air inlet 302 by "negative pressure." Similarly, cold air is pushed out through cold air outlet 304 by centrifugal force, and cold air is drawn in through cold air inlet 303 by "negative pressure." Specifically, the air is sucked into the space between adjacent blades 332 by "negative pressure" and then pushed by blades 332 into the space between blades 332 and impellers 331. Impellers 331 and blades 332 then push the air out through the outlets.

In order to minimize the coupling of the hot and cold air channels, the edges of outer impellers 331 and inner blades 332 should be close to the sidewalls of partitions 312, 316, 313, and 317 so that both hot and cold channels can transport air efficiently. However, this causes whistling when rotary unit 329 rotates at high speed. Therefore, sidewalls 315 (FIG. 3B only) of partitions 312, 316, 313 and 317 that face the edges of outer impellers 331 and inner blades 332 are concave. This reduces the air density immediately after outer impellers 331 and inner blades 332 pass the edges of partitions 312, 316, 313, and 317, and thereby reducing noise.

Housing 310 further includes stationary airfoils 314 (only one is labeled for clarity) at cold air outlet 304, and stationary airfoils 315A at hot air outlet 301, and stationary airfoils 315B (only one is labeled for clarity) at cold air inlet 303. Stationary airfoils 314, 315A, and 315B control the air flow distribution and the air flow direction. For example, stationary airfoils 314 ensure that the cold air exiting through cold air outlet 304 is distributed evenly across the outlet. Furthermore, stationary airfoils 314 ensure that the cold air exits perpendicular to cold air outlet 304. In addition, stationary airfoils 315A help to direct the hot air out through hot air outlet 301 and stationary airfoils 315B help to direct the cold air from cold air inlet 303 to cold air outlet 304. Airfoils 314 have sidewalls 351 that arch away from the edges of outer impellers 331 in order to reduce noise. The exact placement and shape of the stationary airfoils can be calculated through computational fluid dynamics.

Figure 4:
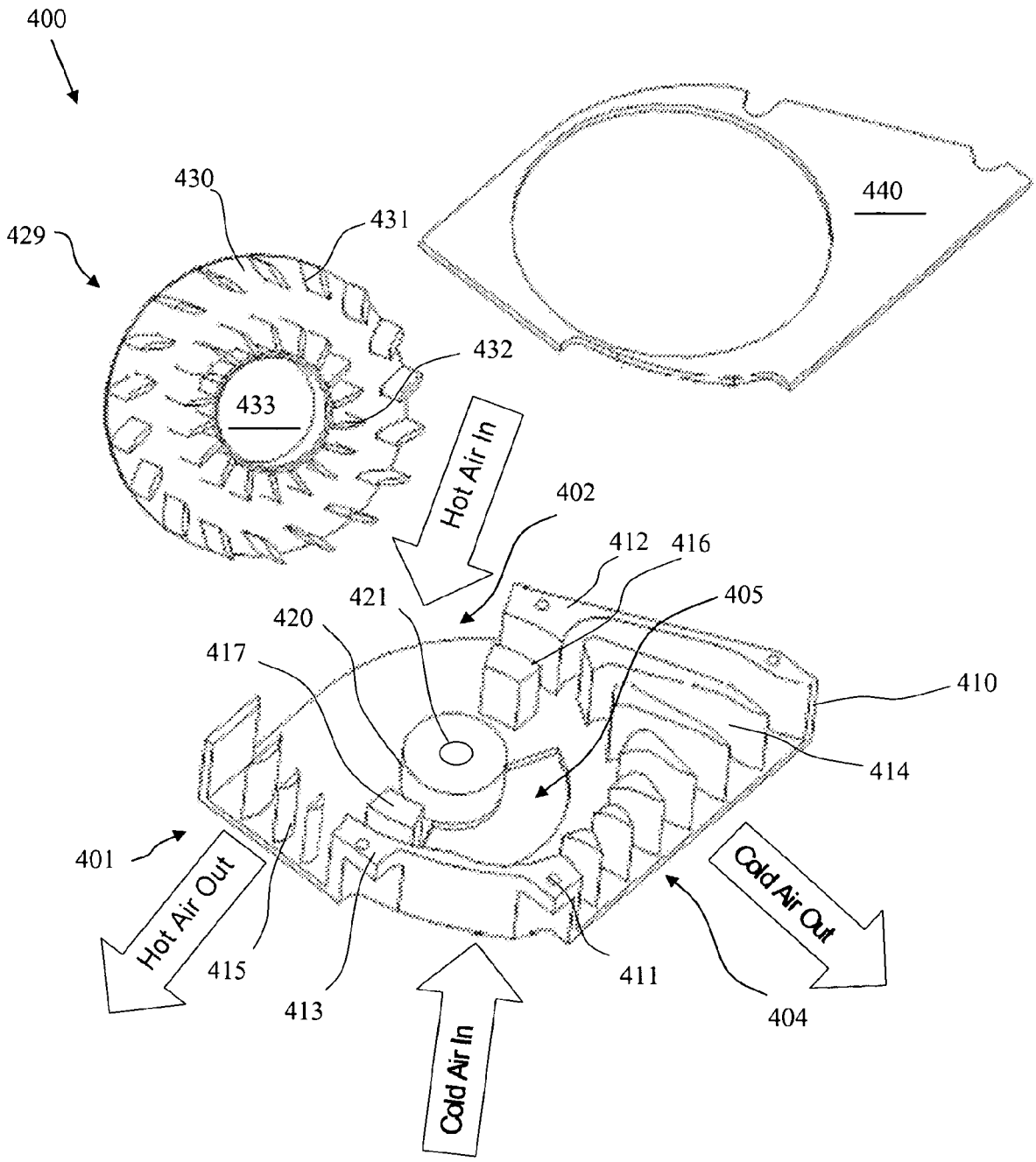
FIG. 4 is an exploded view of a hybrid bi-directional blower in one embodiment of the invention.

FIG. 4 illustrates a hybrid bi-directional blower 400 similar to bi-directional blower 300 in one embodiment of the invention. Blower 400 includes a housing 410, a motor 420, and a rotary unit 429. In one embodiment, rotary unit 429 includes a circular plate 430, outer impellers 431 around the outer perimeter of plate 430, and inner blades 432 around a hub 433 on plate 430. Although not shown, a hoop can be formed on the top of outer impellers 431 to provide structural rigidity. Hub 433 is mounted to a rotor 421 of motor 420. Motor 420 has a stator (not visible) that is mounted to housing 410. A cover 440 encloses the components within housing 410. Housing 410 define screw holes 411 (only one is labeled for clarity) for mounting blower 400 to a system box.

In one embodiment, housing 410 has openings in the sidewalls that define a hot air inlet 402, a hot air outlet 401, and a cold air outlet 404 arranged in that order. Depending on the embodiment, housing 410 may have an opening in the bottom surface of housing 410 that defines a cold air inlet 405, or cover 440 may have an opening that defines the cold air inlet.

The sidewall between hot air inlet 402 and cold air outlet 404 protrudes toward the outer ends of outer impellers 431 to form an outer partition 412, and the sidewall between hot air outlet 401 and cold air outlet 404 protrudes toward the outer ends of outer impellers 431 to form an outer partition 413. Opposite of partition 412 is an inner partition 416 that fits between the outer ends of inner blades 432 and inner ends of outer impellers 431. Opposite of outer partition 413 is an inner partition 417 that fits between the outer ends of inner blades 432 and the inner ends of outer impellers 431. Inner blades 432 are designed to rotate between inner partitions 416 and 417. Outer blades 431 are designed to rotate between inner partition 417 and outer partition 413, and between inner partition 416 and outer partition 412.

Partitions 412, 416, 413, and 417 divide housing 410 into a hot channel for moving air from hot air inlet 402 to hot air outlet 401, and a cold channel for moving air from cold air inlet 405 to cold air outlet 404. Partitions 412, 416, 413, and 417 have widths greater than the pitches of blades 431 and 432 to prevent the air in the hot and cold channels from mixing. When blades 431 and 432 rotate counterclockwise, hot air is pushed out through hot air outlet 401 by centrifugal force, and hot air is drawn in through hot air inlet 402 by "negative pressure." Similarly, air is pushed out through cold air outlet 404 by centrifugal force, and cold air is drawn in through cold air inlet 405 by "negative pressure."

Housing 410 further includes stationary airfoils 414 (only one is labeled for clarity) at cold air outlet 404, and stationary airfoils 415 (only one is labeled for clarity) at hot air outlet 401. Stationary airfoils 414 and 415 control the air flow distribution and the air flow direction. For example, stationary airfoils 414 ensure that the cold air exiting through cold air outlet 404 is distributed evenly across the outlet. Furthermore, stationary airfoils 414 ensure that the cold air exits perpendicular to cold air outlet 404. In addition, stationary airfoils 415 help to direct the hot air out through hot air outlet 401. The exact placement and shape of the stationary airfoils can be calculated through computational fluid dynamics.

Figure 5:
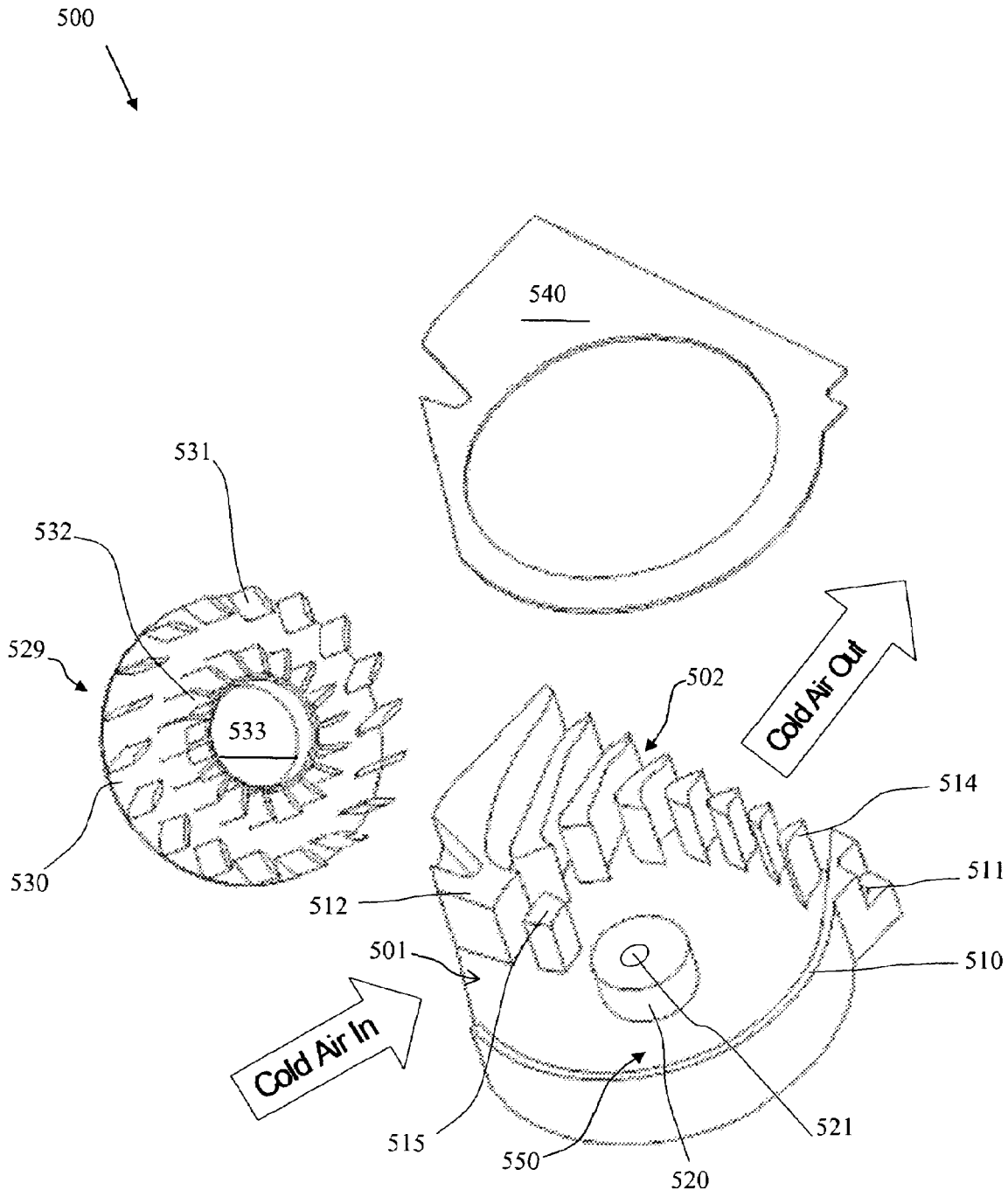
FIG. 5 is an exploded view of a one-way blower in one embodiment of the invention.

FIG. 5 illustrates a one-way blower 500 in one embodiment of the invention. Blower 500 includes a housing 510, a motor 520, and a rotary unit 529. In one embodiment, rotary unit 529 includes a circular plate 530, outer impellers 531 around the outer perimeter of plate 530, and inner blades 532 around a hub 533 on plate 530. Although not shown, a hoop can be formed on the top of outer impellers 431 to provide structural rigidity. Hub 533 is mounted to a rotor 521 of motor 520. Motor 520 has a stator (not visible) that is mounted to housing 510. A cover 540 encloses the components within housing 510. Housing 510 define screw holes 511 (only one is labeled for clarity) for mounting blower 500 to a system box.

In one embodiment, housing 510 has openings in the sidewalls that define a cold air inlet 501 and a cold air outlet 502. The sidewall between cold air inlet 501 and cold air outlet 502 protrudes toward the outer ends of outer impellers 531 to form an outer partition 512. Opposite of partition 512 is an inner partition 515 that fits between the outer ends of inner blades 532 and the inner ends of outer impellers 531. Inner blades 532 are designed to rotate within inner partition 515, and outer impellers 531 are designed to rotate between inner partition 515 and outer partition 512.

Partitions 512 and 515 have widths greater than the pitches of blades 531 and 532 to prevent the air from mixing within blower 500. When outer impellers 531 and inner blades 532 rotate counterclockwise, cold air is pushed out through cold air outlet 502 by centrifugal force. At the same time, cold air is drawn in through cold air inlet 501 by "negative pressure" and travels through a circular tunnel 550 before being pushed out.

Housing 510 further includes stationary airfoils 514 (only one is labeled for clarity) at cold air outlet 502. Stationary airfoils 514 control the air flow distribution and the air flow direction. For example, stationary airfoils 514 ensure that the cold air exiting through cold air outlet 502 is distributed evenly across the outlet. Furthermore, stationary airfoils 514 ensure that the cold air exits perpendicular to cold air outlet 502. The exact placement and shape of the stationary airfoils can be calculated through computational fluid dynamics.

Blower 500 is to be mounted in a system box. In one embodiment, the system box is a computer case, such as a laptop case. Blower 500 is oriented so cold air inlet 501 faces the outside of the system box to draw in cold air. In one embodiment, cold air outlet 502 faces a heat sink so that the cold air passes over the heat sink before exiting the system box.

Blower 500 has several notable features. First, cold air intake 501 is located on the side of housing 510 instead of the top or the bottom of housing 510 like a conventional centrifugal blower. Using blower 500, the air gap between the bottom of a laptop and a desktop can be eliminated for better heat conduction. Furthermore, the single channel provides a high flow capacity. Second, airfoils 514 provide an even air flow at cold air outlet 502.

Figure 6A:
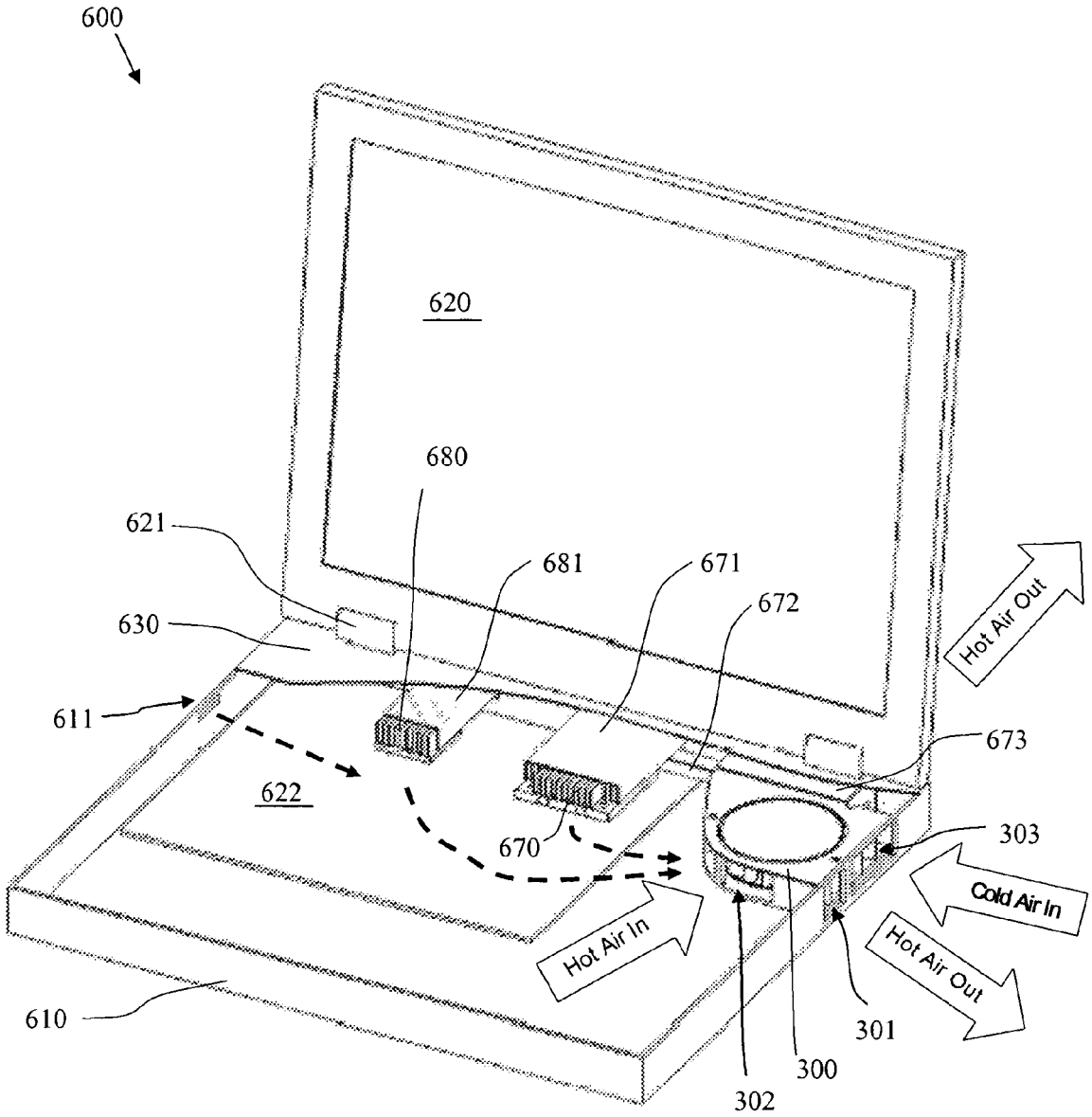
FIGS. 6A and 6B are front and back perspective views of a laptop computer the bi-directional blower of FIG. 3 in one embodiment of the invention.
Figure 6B:
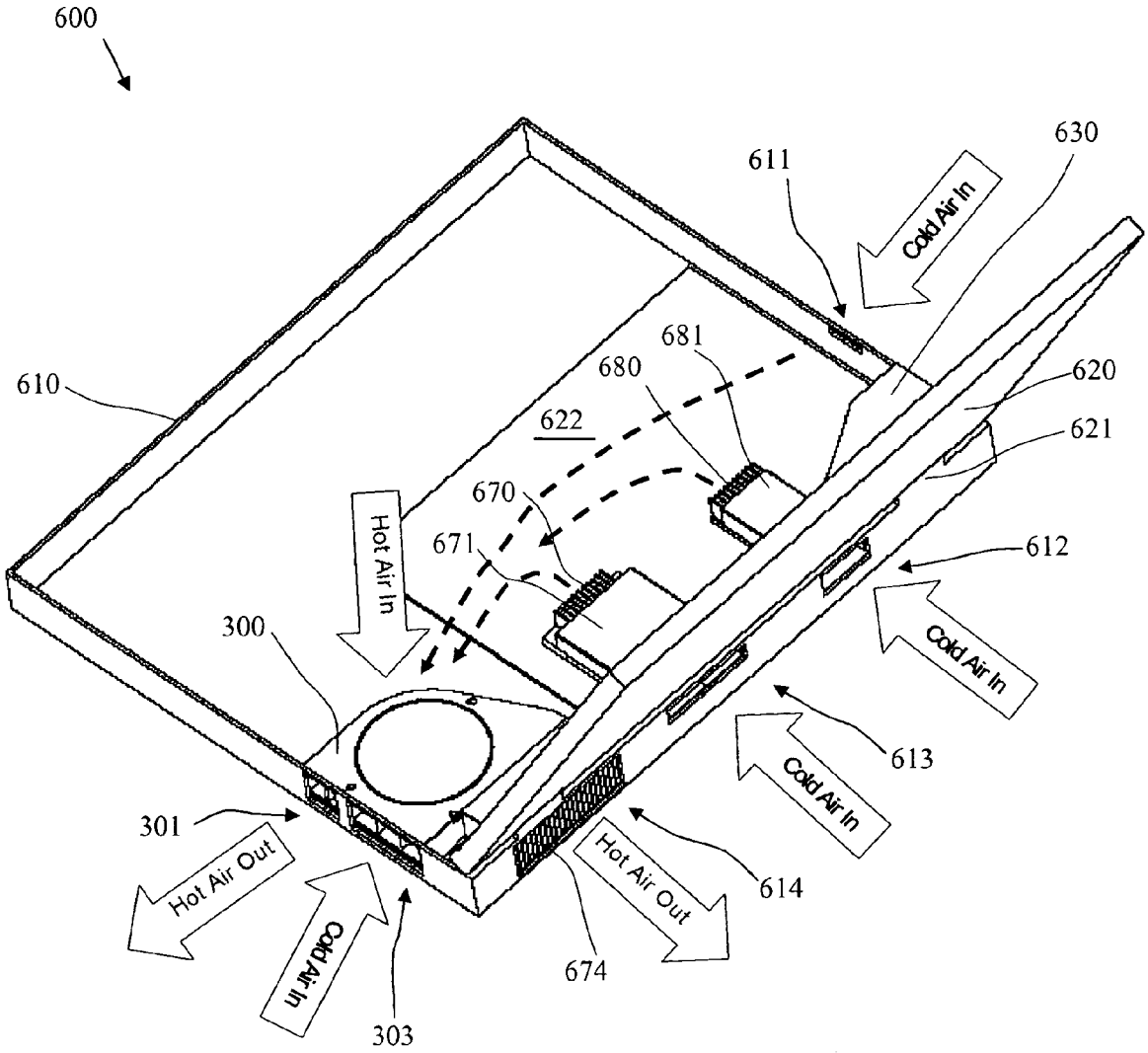

FIGS. 6A and 6B illustrate a form factor of a laptop computer 600 with bi-directional blower 300 (FIG. 3) in one embodiment of the invention. Although shown with blower 300, any of the bi-directional blowers described above may be fitted in laptop 600. Laptop 600 includes a system case 610, a cover 630, and a display 620 connected to case 610 with hinges 621 (only one is labeled for clarity). Additional components, such as the keyboard, the optical drive, the battery, the track pad, and various ports, are not shown in order to better illustrate the thermal paths in laptop 600.

A heat sink 670 is mounted on top of a CPU package (not visible) on a printed circuit board (PCB) 622. A duct 671 is mounted on top of the fins of heat sink 670. Duct 671 opens to a vent 613 (FIG. 6B only) on the back wall of case 610. This allows ambient air to be drawn into case 610 and through the fins of heat sink 670. Ambient air is drawn into case 610 when blower 300 sucks in the hot air within case 610 through inlet 302 (FIG. 6A only) and blows out the hot air through outlet 301.

Heat sink 670 is connected to a heat pipe 672 (FIG. 6A only). Heat pipe 672 transfers heat from the base of heat sink 670 to fins 674 (FIG. 6B only) located in a heat sink 673 (FIG. 6A only). Heat sink 673 is connected to a vent 614 (FIG. 6B only) on the back wall of case 610. Blower 300 sucks in the ambient air through inlet 303 and blows the ambient air through fins 674 and out from vent 614. Inlet 303 is coupled to a vent on the sidewall of case 610.

A heat sink 680 is mounted on top of a video graphics package (not visible) on PCB 622. A duct 681 is mounted on top of heat sink 680. Duct 681 opens to a vent 612 (FIG. 6B only) on back wall of case 610. This allows ambient air to be drawn into case 610 and through the fins of heat sink 680. Ambient air is drawn into case 610 when blower 300 sucks in the hot air within case 610 through inlet 302 (FIG. 6A only) and blows out the hot air through outlet 301 through a vent on the sidewall of case 610

In order to have more thermal flow paths, more vents like vent 611 may be added on the walls of case 610. The flow paths of the hot air begin with ambient air at vents 611, 612, and 613. The ambient air is sucked into inlet 302 of bi-directional blower 300 and out of case 610 through outlet 301. Along the way, the ambient air carries heat away from heat sink 670, heat sink 680, and other electronics components in case 610 (e.g., the random access memory and the hard drive).

Figure 7:
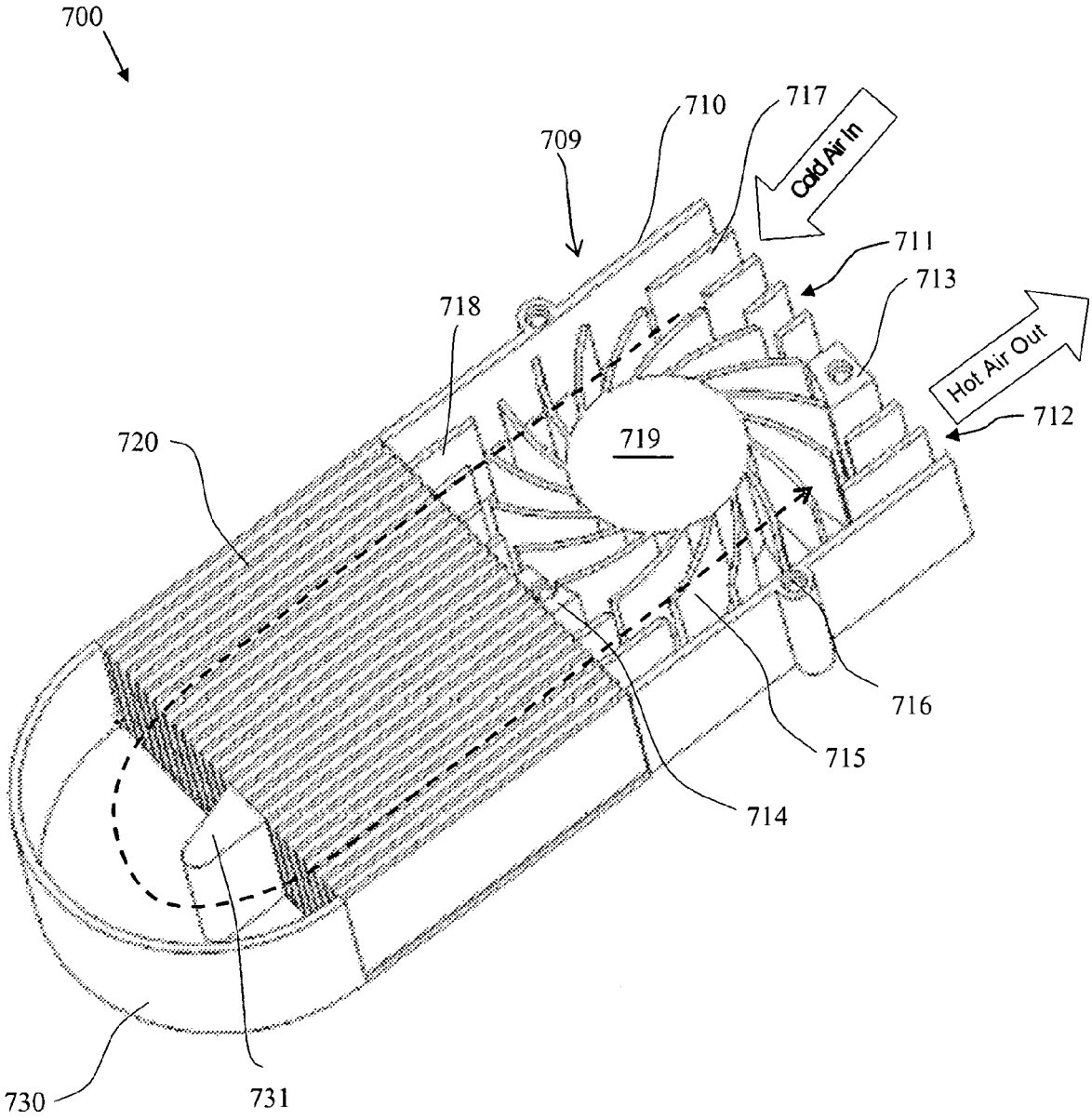
FIG. 7 is a perspective view of a bi-directional blower cooling module for a PCI card in one embodiment of the invention.

FIG. 7 illustrates a bi-directional blower cooling module 700 for a computer expansion card in one embodiment of the invention. For example, module 700 may be mounted on a PCI video graphics card. Module 700 includes a heat sink 720 mounted on top of the one or more electronic components to be cooled. A round duct 730 with a divider wall 731 is mounted to a first side of the fins of heat sink 720. Round duct 730 provides a return path for an air flow.

A blower 709 is mounted on a second side of the fins of heat sink 720. Blower 709 includes a housing 710, a motor (not visible), and a rotary unit. The rotary unit includes blades 715 extending from a hub 719. Hub 719 is mounted to a rotor of the motor. The motor has a stator that is mounted to housing 710.

Housing 710 includes airfoils 718 and a partition 714 abutting the fins of heat sink 720. Housing 710 further includes airfoils 717 and a partition 713 on the opposite side of the rotary unit. Partitions 713 and 714 have widths greater than the pitch of blades 715 to prevent the air from mixing in two separate channels. Airfoils 717 and 718 are used to control air flow distributions and the air flow directions at the various inlets and outlets.

Screw holes 716 (only one is labeled) are used to fix module 700 to the computer expansion card. A cover (not shown) is placed over duct 730, the fins of heat sink 720, and blower 709. The cover is not shown to illustrate the inner workings of module 700.

Partitions 713 and 714 divide module 700 into two channels, and round duct 730 couples the output of one channel to the input of the other channel. As blades 715 rotating counterclockwise, cold air is drawn in by "negative pressure" through a cold air inlet 711 on a first side of partition 713. The cold air is then pushed out through a cold air outlet formed by airfoils 718 located on a first side of partition 714. The cold air immediately passes through the fins on the first side of partition 714 and divider wall 731. After absorbing heat from the fins, the heated air travels in round duct 730 and then passes through the fins on a second side of divider wall 731 and partition 714. After absorbing more heat from the fins, the hot air is drawn through a hot air inlet formed by airfoils 718 on the second side of partition 714 by "negative pressure." The hot air is then pushed out by centrifugal force through a hot air outlet 712 on a second side of partition 713.

Since hot air outlet 712 is made smaller than cold air inlet 711, the hot air moves faster in the hot air channel than the cold air moves in the cold air channel. Thus, the cooling efficiency on both channels may be balanced. As a closed structure, module 700 is a thermal solution almost independent of the thermal design of the system box because the air is not pushed into or drawn out of the system box. In other words, the thermal impact to an existing system is minimized if a PCI card with module 700 is added with inlet 711 and outlet 712 couple to vents on the backside of the system box.

Figure 8:
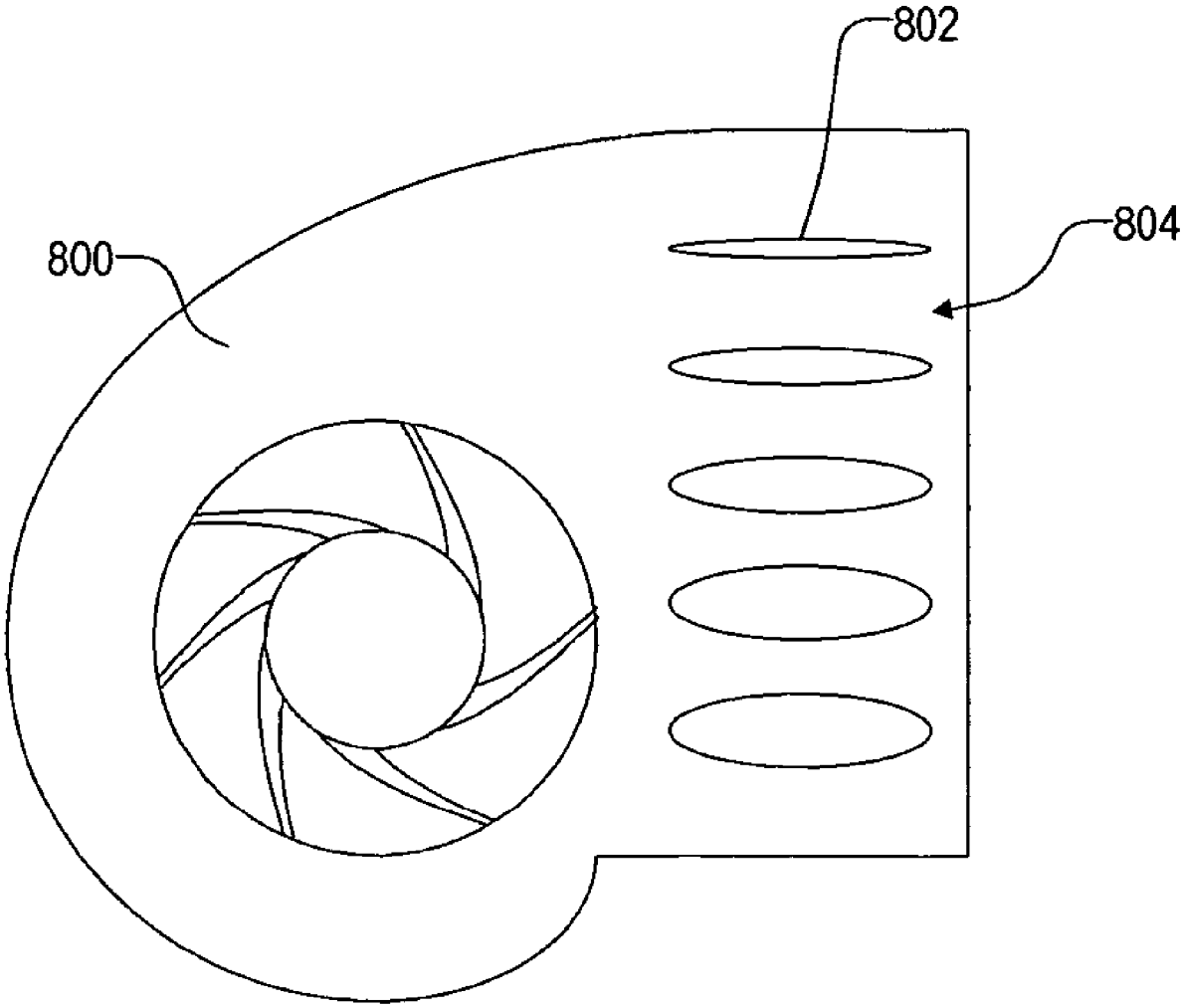
FIG. 8 is a top view of a centrifugal blower in one embodiment of the invention.

FIG. 8 illustrates a centrifugal blower 800 in one embodiment of the invention. Blower 800 is conventional except that stationary airfoils 802 are provided at an air outlet 804. Stationary airfoils 802 provide an even air flow across outlet 804. Stationary airfoils 802 also provide the air flow along a desired direction. The exact placement and shape of the stationary airfoils can be calculated through computational fluid dynamics.

Various other adaptations and combinations of features of the embodiments disclosed are within the scope of the invention. Numerous embodiments are encompassed by the following claims.

What is claimed is:

1. A bi-directional blower, comprising:

a motor;

a rotary unit, comprising:

a hub mounted to the motor; and blades extending from the hub; and a housing receiving the motor and the rotary unit, the housing comprising a first air inlet, a first air outlet, a second air inlet, a second air outlet, a first partition wall located adjacent to ends of the blades and between the first air inlet and the second air outlet, and a second partition wall located adjacent to the ends of the blades and between the first air outlet and the second air inlet, wherein:

the housing is divided into first and second subspaces by the blades and the first and the second partition walls;

the first and the second partition walls have widths that are greater than a blade pitch;

a first channel is formed with the first air inlet, the first subspace, and the first air outlet; and a second channel is formed with the second air inlet, the second subspace, and the second air outlet.

2. The blower of claim 1, wherein:

the first air inlet, the first air outlet, the second air inlet, and the second air outlet are defined on sidewalls of the housing in that order.

3. The device of claim 1, wherein the housing further comprises a first plurality of stationary airfoils at the first air outlet and a second plurality of stationary airfoils at the second air outlet, the first and the second pluralities of stationary airfoils providing desired air flow distributions and desired air flow directions from the first air outlet and the second air outlet.

4. The device of claim 3, wherein the housing further comprises a third plurality of stationary airfoils at the second air inlet, the third plurality of stationary airfoils providing desired air flow from the second air inlet to the second air outlet.

5. The blower of claim 1, wherein the first air outlet is smaller than the second air inlet to minimize a mixing of air from the first channel and the second channel.

6. A heat dissipating device, comprising:

a motor;

a rotary unit, comprising:

a hub mounted to the motor;

blades extending from the hub;

a housing receiving the motor and the rotary unit, wherein:

the housing defines a hot air inlet, a hot air outlet, and a cold air outlet on sidewalls of the housing in that order;

the housing defines a cold air inlet on one of a floor of the housing and a cover of the housing;

the housing comprises a first partition and a second partition located close to outer ends of the blades, the first partition and the second partition dividing the housing into (1) a first channel coupling the hot air inlet and the hot air outlet and (2) a second channel coupling the cold air inlet and the cold air outlet, the first partition being formed by a first sidewall of the housing between the hot air outlet and the cold air outlet, the first sidewall protruding close to the outer ends of the blades, and the second partition being formed by a second sidewall of the housing between the cold air outlet and the hot air inlet, the second sidewall protruding close to the outer ends of the blades.

7. A bi-directional blower, comprising:

a motor;

a hub mounted to the motor;

blades extending from the hub;

a circular plate on the hub; and a ring of impellers on the circular plate; and a housing receiving the motor and the rotary unit, wherein:

the housing defines a first air inlet, a first air outlet, a second air inlet, and a second air outlet; and the housing comprises:

first and second partitions located between outer ends of the blades and inner ends of the impellers, the first partition and the second partition dividing the housing into (1) a first channel coupling the first air inlet and the first air outlet and (2) a second channel coupling the second air inlet and the second air outlet;

a third partition located opposite the first partition and close to outer ends of the impellers; and a fourth partition located opposite the second partition and close to the outer ends of the impellers.

8. The blower of claim 7, wherein:

the first and the second partitions have concave sidewalls facing the outer ends of the blades and the inner ends of the impellers; and the third and the fourth partitions have concave sidewalls facing the outer ends of the impellers, wherein the concave sidewalls reduce noise.

9. The blower of claim 7, wherein the rotary unit further comprises:

a hoop on top of the impellers providing structural rigidity to the impellers.

10. A computer system, comprising:

a case defining a first vent, a second vent, and a third vent;

a heat source in the case;

a heat dissipating device inside the case, the heat dissipating device comprising:

a motor;

a rotary unit mounted on the motor;

a housing receiving the motor and the rotary unit, wherein:

the housing defines a hot air inlet, a hot air outlet, a cold air inlet, and a cold air outlet, the hot air inlet being coupled to an interior of the case, the hot air outlet being coupled to the first vent, the cold air inlet being coupled to the second vent, the cold air outlet being coupled to the third vent through the interior of the case.

11. The system of claim 10, wherein:

the first, the second, and the third vents are defined on sidewalls of the case; and the hot air inlet, the hot air outlet, the cold air inlet, and the cold air outlet are defined on sidewalls of the housing.

12. The system of claim 11, wherein:

the rotary unit comprises:

a circular plate a hub on the circular plate;

blades extending from the hub;

a ring of impellers on the circular plate around the blades;

the housing further comprises:

a first partition and a second partition being located between outer ends of the blades and inner ends of the impellers;

a third partition between the hot air outlet and the cold air inlet, the third partition being located opposite the first partition and close to outer ends of the impellers; and a fourth partition between the cold air outlet and the hot air inlet, the fourth partition being located opposite the second partition and close to the outer ends of the impellers.

13. The system of claim 10, wherein the case further defines a fourth vent, the system further comprising:

a heat sink mounted to the heat source; and a duct coupling the heat sink to the fourth vent.

14. The system of claim 10, further comprising:

a first heat sink mounted to the heat source;

a second heat sink comprising a plurality of fins between the cold air outlet and the third vent; and a heat pipe coupling the first heat sink and the second heat sink.

15. A blower, comprising:

a motor;

a rotary unit, comprising:

a hub mounted to the motor;

blades extending from the hub;

a housing receiving the motor and the rotary unit, wherein:

the housing defines an inlet and an outlet;

the housing comprises a partition, the partition being close to outer ends of the blades, the partition being located between the inlet and the outlet, the first partition having a width greater than a pitch of the blades so that air from the inlet and the outlet do not mix.

16. The blower of claim 15, wherein the inlet and the outlet are defined on sidewalls of the housing.

17. The blower of claim 15, wherein the rotary unit further comprises:

a circular plate on the hub;

a ring of impellers on the circular plate around the blades, wherein the partition is located between the outer ends of the blades and inner ends of the impellers;

the housing farther comprises:

another partition located opposite the partition and close to outer ends of the impellers.

18. The blower of claim 15, wherein the housing further comprises stationary airfoils located at the outlet, the stationary airfoils providing a desired air flow distribution and a desired air flow direction from the outlet.

19. A cooling module, comprising:

a heat sink comprising fins;

a round duct mounted adjacent to a first side of the heat sink, the round duct comprising a dividing wall abutting the fins of the heat sink;

a heat dissipating device mounted adjacent to a second side of the heat sink, the device comprising:

a motor;

a rotary unit, comprising:

a hub mounted to the motor;

blades extending from the hub;

a housing receiving the motor and the rotary unit, wherein:

the housing defines a cold air inlet, a cold air outlet, a hot air inlet, and a hot air outlet, the cold air outlet and the hot air outlet abutting the fins of the heat sink;

the housing comprises a first partition and a second partition, the first partition being located close to outer ends of the blades, the first partition being located between the cold air inlet and the hot air outlet, the second partition being located between the cold air outlet and the hot air inlet, the first and the second partitions dividing the housing into (1) a first channel coupling the cold air inlet and the cold air outlet and (2) a second channel coupling the hot air inlet and the hot air outlet.

20. The device of claim 19, wherein the cold air inlet and the cold air outlet are greater than the hot air inlet and the hot air outlet so that the first channel is greater than the second channel.

21. The device of claim 19, further comprising stationary airfoils at the cold air inlet, the cold air outlet, the hot air inlet, and the hot air outlet, the stationary airfoils providing desired air flow distributions and desired air flow directions.

* * * * *